US005404117A

United States Patent [19]

Walz

[11] Patent Number: 5,404,117

[45] Date of Patent: Apr. 4, 1995

[54] CONNECTOR FOR STRIP-TYPE TRANSMISSION LINE TO COAXIAL CABLE

[75] Inventor: Dale D. Walz, Colorado Springs, Colo.

[73] Assignee: Hewlett-Packard Company, Palo Alto, Calif.

[21] Appl. No.: 131,049

[22] Filed: Oct. 1, 1993

[51] Int. Cl.[6] ..... H01P 1/04

[52] U.S. Cl. ..... 333/34; 333/260; 439/63

[58] Field of Search ..... 333/33, 34, 260; 439/581, 63

[56] References Cited

U.S. PATENT DOCUMENTS 3,622,915 11/1971 Davo ..... 333/34
4,110,712 8/1978 Morris ..... 333/33
4,867,704 9/1989 Standke ..... 439/581
4,995,815 2/1991 Buchanan et al. ..... 439/63

OTHER PUBLICATIONS

T. C. Edwards, Foundations for Microstrip Circuit Design, 1981, pp. 174–179.

*Primary Examiner*—Paul Gensler
*Attorney, Agent, or Firm*—Augustus W. Winfield

[57] ABSTRACT

An electronic connector for connecting a coaxial cable to a microstrip transmission line or to a coplanar transmission line. The connector has a transition length which is long enough to be treated as a transmission line rather than as a lumped element. In one embodiment, the transition is linear. In a optimal embodiment for minimal distortion, the transition follows a cosine shape.

4 Claims, 15 Drawing Sheets

CONNECTOR FOR STRIP-TYPE TRANSMISSION LINE TO COAXIAL CABLE

FIELD OF INVENTION

This invention relates to electronic connectors and more particularly to connectors for connecting a coaxial cable to a high frequency microstrip or coplanar transmission line.

BACKGROUND OF THE INVENTION

High frequency electronic signals need transmission lines to minimize distortion and attenuation. For transmission over long distances, a coaxial cable may be used. For transmission over short distances within circuit modules, there are three common transmission line configurations, all referred to by the generic term "strip-type transmission line." The first strip-type transmission line configuration is a strip conductor above an extended ground plane (also called a microstrip). The second configuration is a strip conductor between (coplanar) extended parallel conducting surfaces. The third configuration is a strip conductor embedded within a dielectric substrate with extended ground planes on the top and bottom surfaces of the substrate (also called a stripline). The present invention is primarily concerned with the first two strip-type transmission line configurations; the microstrip configuration and the coplanar configuration.

Ideally, for any multiple segment transmission-line system, each segment of the transmission line should have the same characteristic impedance. This is not always practical, however, in a real system. A transition from a microstrip or a coplanar transmission line to coaxial cable creates an unavoidable discontinuity in the electric fields which results in a discontinuity in the effective transmission line impedance and signal distortion due to reflections. This distortion may be minimized by proper transition geometry.

If the length of a transition path (connector) is much shorter than the distance a signal propagates during a time interval equal to the signal rise time, the transition path (connector) can be treated as a lumped element. If the length of a transition path is on the order of the distance a signal propagates during a time interval equal to the pulse rise time, the transition path must be treated as a transmission line. At gigahertz clock rates and picosecond rise times, the length and shape of a connector becomes important. A connector is needed which minimizes reflections by providing a non-abrupt transition from a coaxial cable to a microstrip or coplanar transmission line.

SUMMARY OF THE INVENTION

The present invention is a connector with a non-abrupt transition from a coaxial cable to a microstrip or co-planar transmission line. In one embodiment, the transition is linear for ease in manufacturing. In other embodiments, an optimal (constant rate of change of the differential area of the ground during the transition) non-linear (Cosine) shape for the transition minimizes distortion over higher frequencies.

DETAILED DESCRIPTION OF THE PREFERRED EMBODIMENT OF THE INVENTION

Figure 1A:
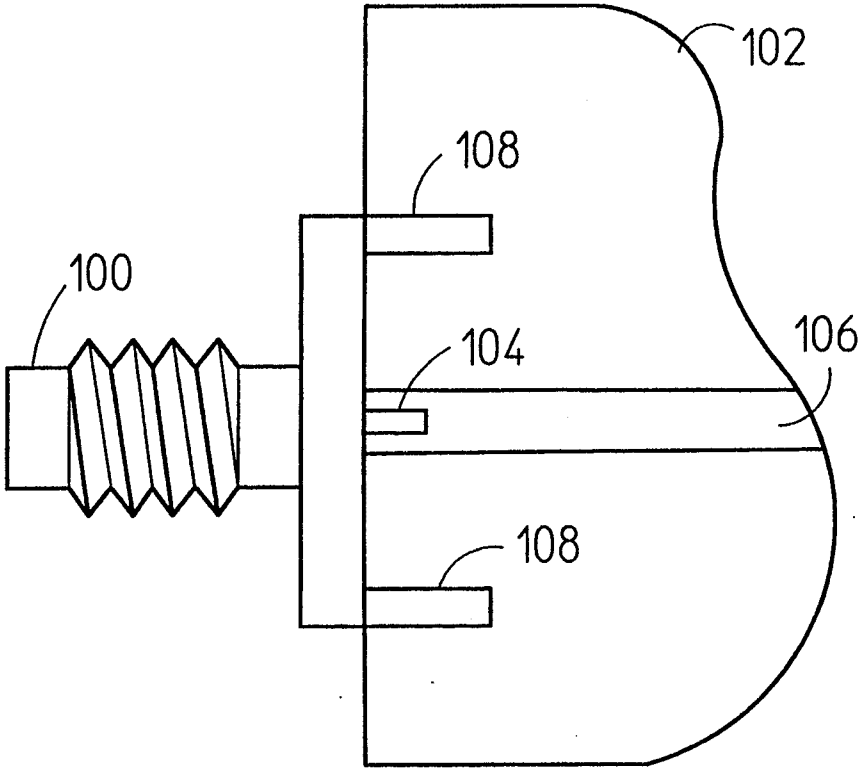
FIG 1A (PRIOR ART)
FIG. 1A (prior art) is a top view of a coaxial edge connector attached to a substrate.

FIG. 1A (prior art) illustrates a coaxial edge connector 100 attached to a substrate 102. The coaxial connector 100 has a center conductor 104 which is soldered to a signal trace 106 on the substrate 102. The coaxial connector 100 has tabs 108 that provide mechanical support. The tabs 108 are electrically connected to the outer conductor (barrel) of the coaxial connector 100. For a coplanar transmission line, the tabs 108 are soldered to metal ground areas on the top of the substrate 102 as illustrated in FIG. 1D.

Figure 1B:
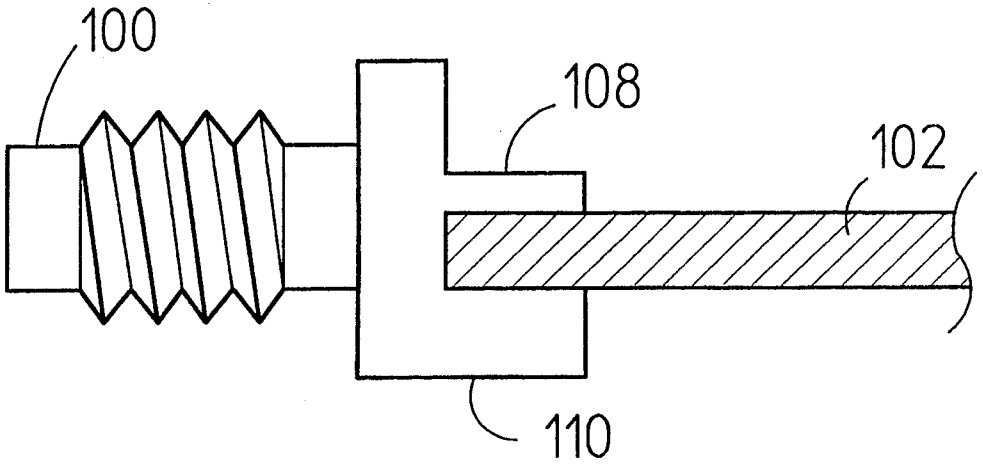
FIG 1B (PRIOR ART)
FIG. 1B (prior art) is a side view of the coaxial edge connector of FIG. 1A.

FIG. 1B (prior art) illustrates a side view of the connector illustrated in FIG. 1A. As illustrated in FIG. 1B, there are also tabs 110 which provide mechanical support below the substrate 102. As with the tabs 108, the tabs 110 are electrically connected to the outer conductor (barrel) of the coaxial connector 100. For a microstrip transmission line, the lower tabs 110 are soldered to a ground plane on the bottom of substrate the 102 as illustrated in FIG. 1C.

Figure 1D:
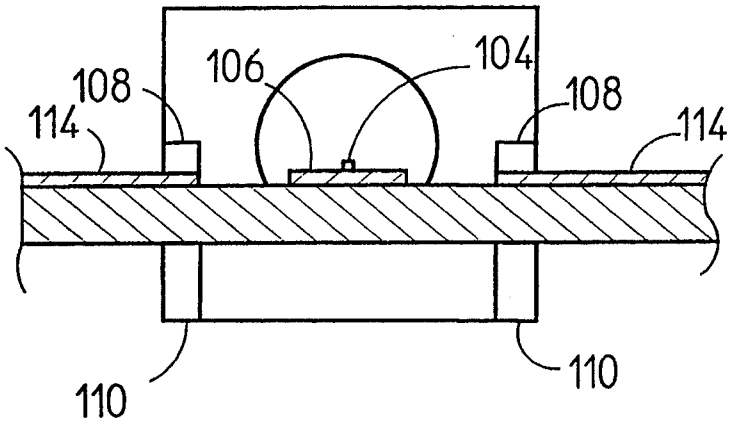
FIG 1D (PRIOR ART)
FIG. 1D (prior art) is an end view of the coaxial edge connector of FIG. 1A attached to a coplanar transmission line.
Figure 1C:
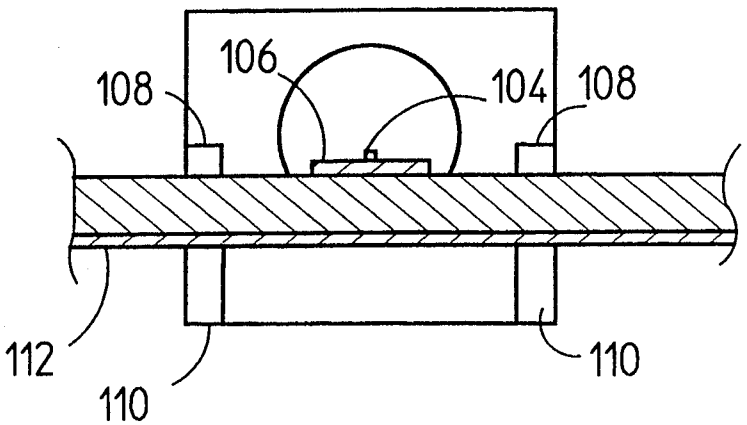
FIG 1C (PRIOR ART)
FIG. 1C (prior art) is an end view of the coaxial edge connector of FIG. 1A attached to a microstrip transmission line.

FIG. 1C (prior art) illustrates a back end view of the connector 100 as attached to a microstrip transmission line. As illustrated in FIG. 1C, the signal conductor 106 is above an extended ground plane 112. In this configuration, the lower tabs 110 are soldered to the lower ground plane 112 for transmission line purposes and the upper tabs 108 are for mechanical support only.

FIG. 1D (prior art) illustrates an back end view of the connector 100 as attached to a coplanar transmission line. As illustrated in FIG. 1D, the signal conductor 106 is between two coplanar ground planes 114. In this configuration, the upper tabs 108 are soldered to the coplanar ground planes 114 for transmission line purposes and the lower tabs 110 are for mechanical support only.

Figure 2C:
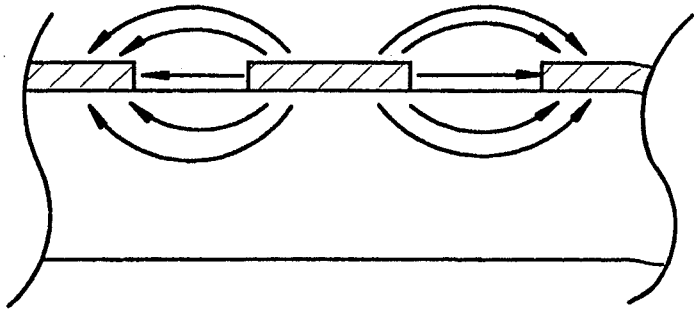
FIG. 2C is a cross-section end view of a coplanar strip type transmission line illustrating electric field lines.
Figure 2B:
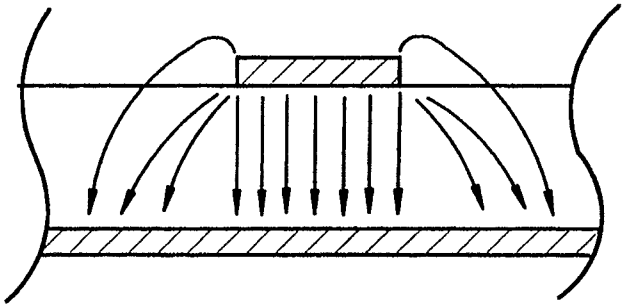
FIG. 2B is a cross-section end view of a microstrip transmission line illustrating electric field lines.
Figure 2A:
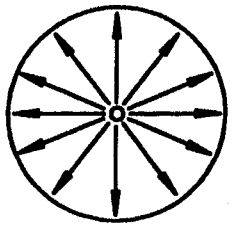
FIG. 2A is an end view of a coaxial transmission line illustrating electric field lines.

FIG. 2A illustrates electric field lines in a coaxial cable. FIG. 2B illustrates electric field lines in a microstrip transmission line. FIG. 2C illustrates electric field lines in a coplanar transmission line. A connector in accordance with the present invention must make a transition from field lines as illustrated in FIG. 2A to field lines as illustrated in either FIG. 2B or FIG. 2C. As illustrated in FIGS. 1C and 1D, in a prior art connector, the spacing from the center conductor 104 to ground makes an abrupt transition from the radius of the coaxial connector to the spacing between the tabs 108 or 110. In addition, for a unit distance along the center conductor 104, the area of ground for electric field lines to the center conductor 104 makes an abrupt transition from the inner circumference of the coaxial connector to either an infinite length ground plane in FIG. 1C (and FIG. 2B) or to two coplanar linear strips in FIG. 1D (and FIG. 2C). This abrupt transition in spacing and area causes a mismatch in effective transmission line impedance between the coaxial transmission line and the microstrip or coplanar transmission lines, causing undesired reflections.

Figure 3:
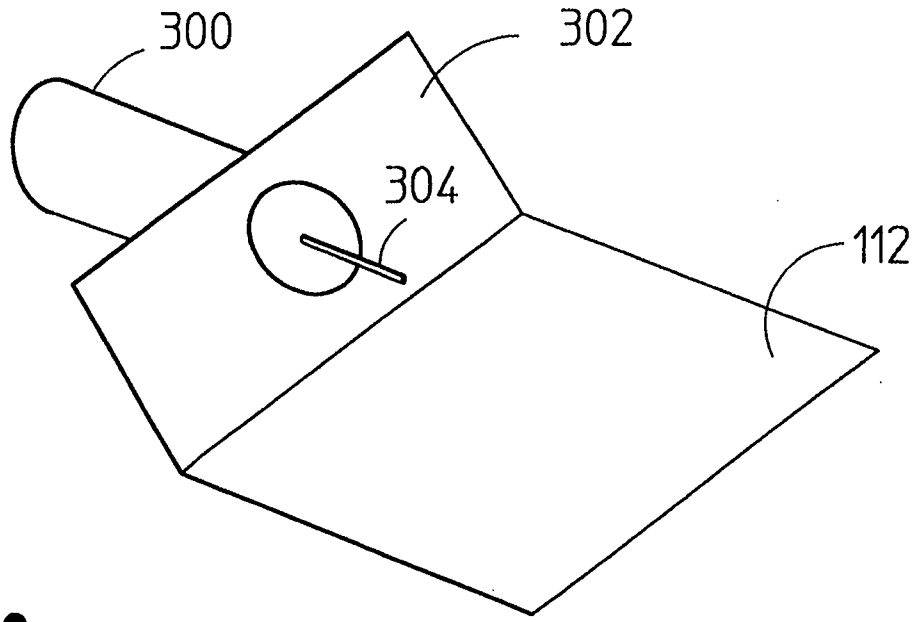
FIG. 3 is a simplified perspective view of a coaxial to microstrip connector with a linear transition.

A simple linear transition over a distance which is long relative to the distance a signal propagates during a time interval equal to the signal rise time improves the transmission line characteristics relative to an abrupt transition. FIG. 3 illustrates a simplified perspective view of a transition from a coaxial cable to a microstrip transmission line. The coaxial cable 300 has a center conductor 304. A conductive wall 302 is integral with the shield of the coax 300 and the conductive wall 302 is formed at a non-perpendicular angle relative to the ground plane 112. In the configuration of FIG. 3, starting at the coaxial cable portion and progressing towards the microstrip, the grounded metal affecting the transmission line characteristics gradually makes a transition from a cylinder to a plane.

Figure 4A:
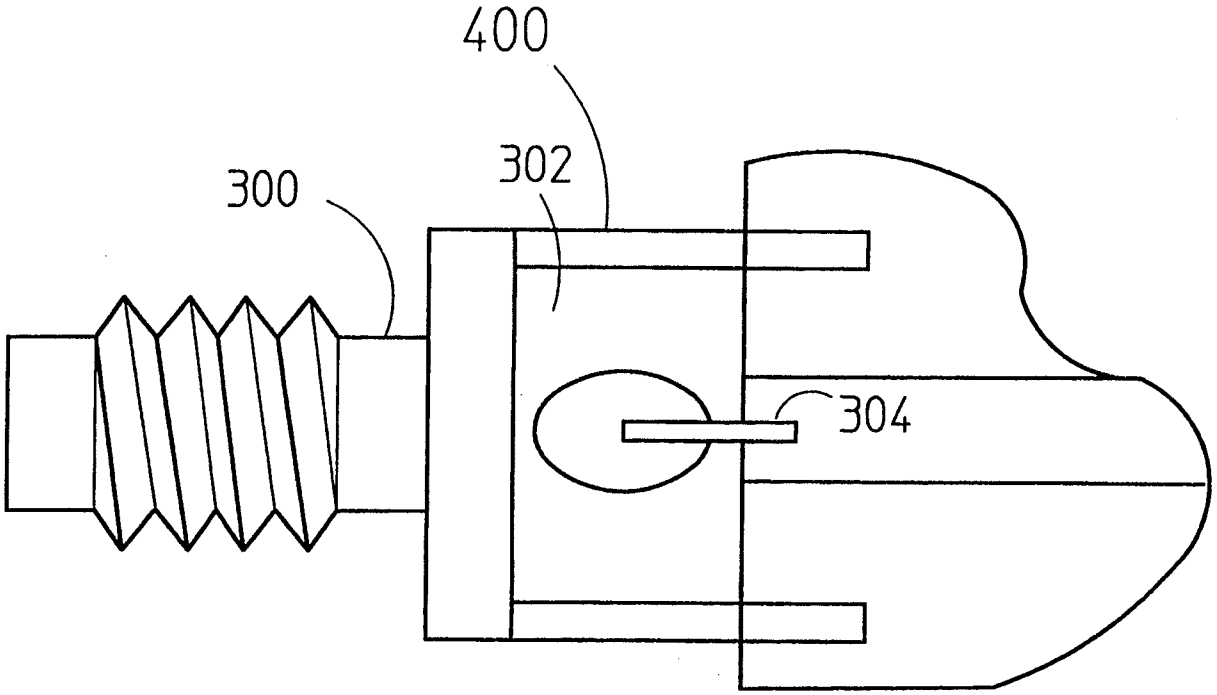
FIG. 4A is a top view of a coaxial to microstrip connector with a linear transition in accordance with one embodiment of the present invention.
Figure 4B:
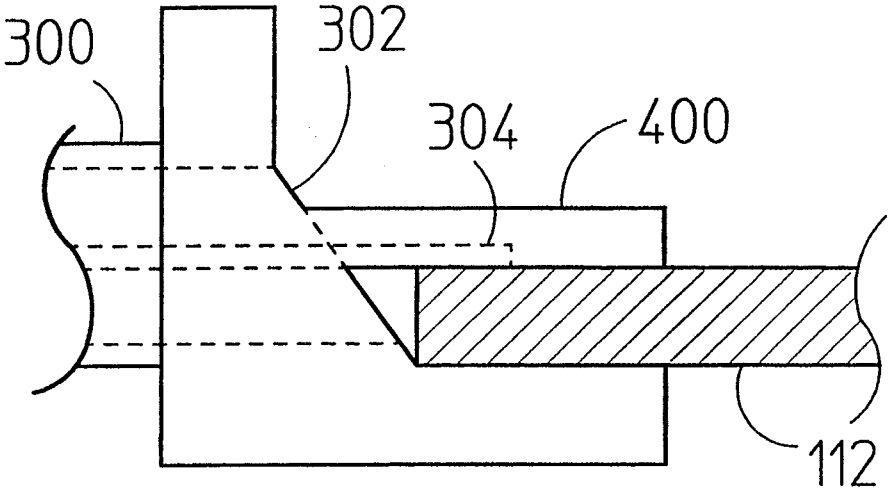
FIG. 4B is a side view of the coaxial edge connector illustrated in FIG. 4A.

FIG. 4A is a top view of a connector which embodies the linear transition from coax to microstrip of FIG. 3. FIG. 4B is a side view of the connector of FIG. 4A. Upper tabs 400 are for mechanical support only.

Figure 5A:
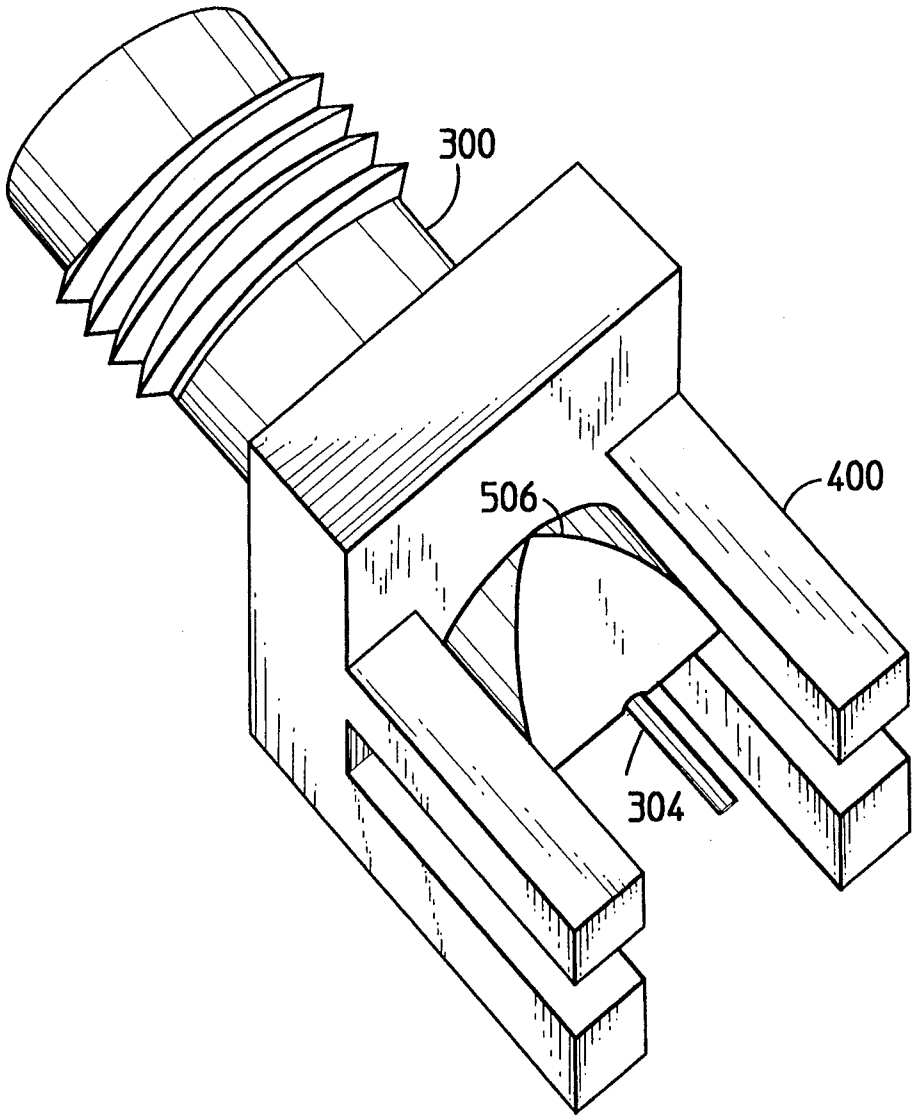
FIG. 5A is a prospective view of a coaxial to coplanar transmission line connector with a linear transition in accordance with one embodiment of the present invention.
Figure 5B:
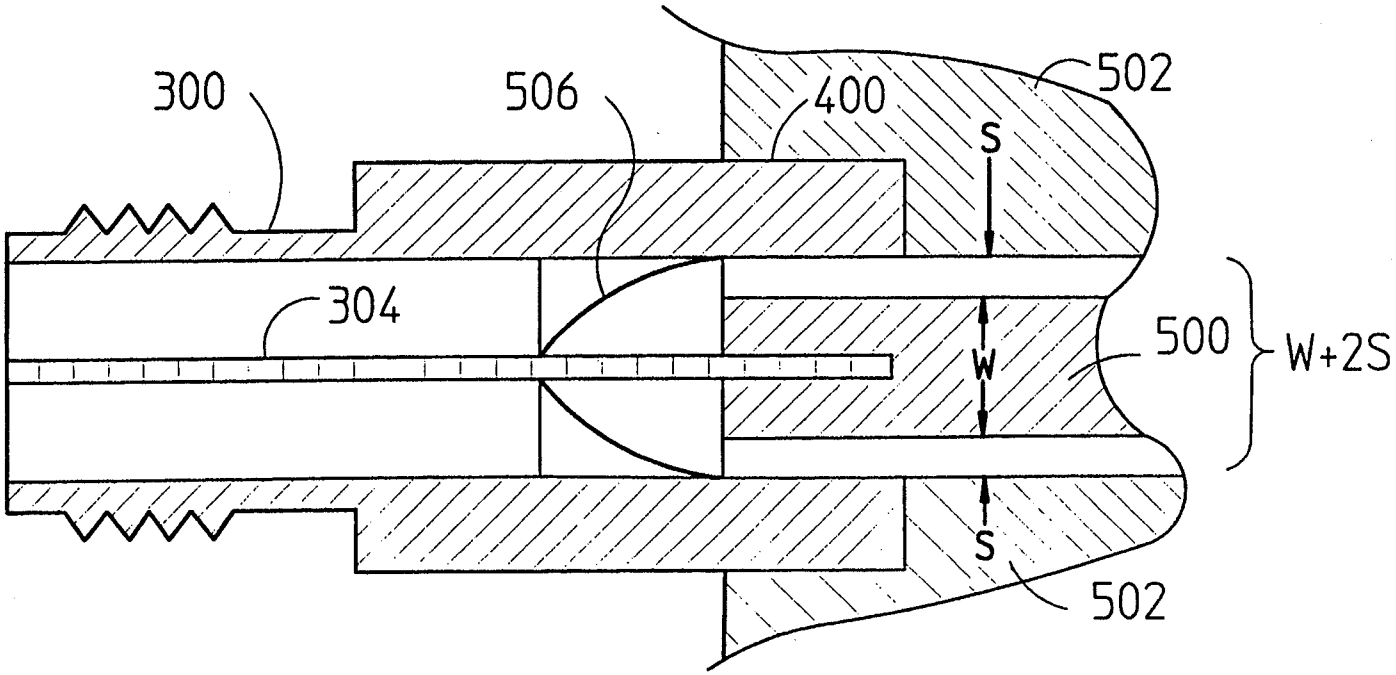
FIG. 5B is a cross-section top view of the connector of FIG. 5A.
Figure 5C:
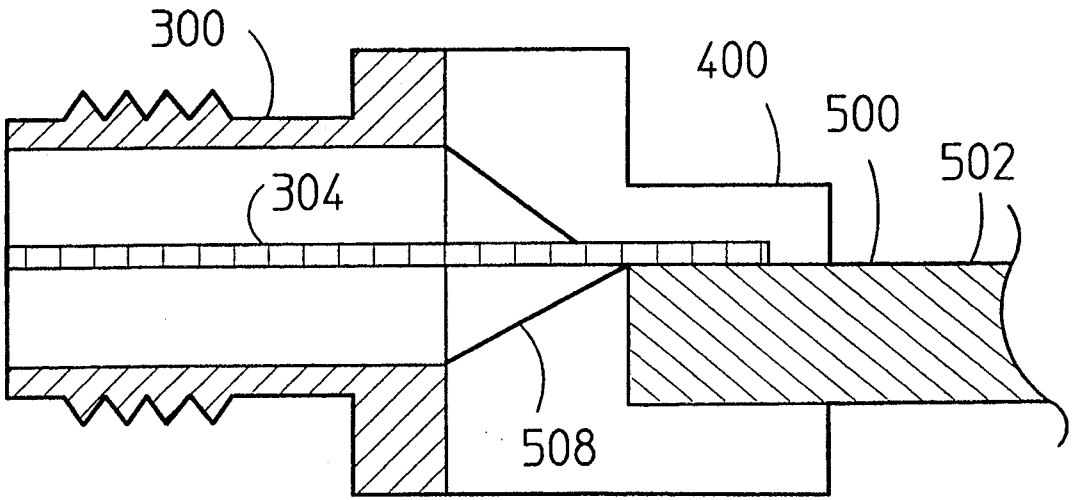
FIG. 5C is a cross-section side view of the connectors of FIG. 5A and 5B.

FIG. 5A is perspective view of a connector which has a linear translation from a coax to a coplanar strip type transmission line. In FIG. 5B, the width of the coplanar center conductor 500 is W and the spacing between the center conductor 500 and the coplanar ground strips 502 is S. The distances S and W can be varied to match the characteristic impedance of the coax. To simplify the transition, the spacing between the tabs (W+2S) is preferably set to the inner diameter of the coax as illustrated in FIG. 5B and the distances W and S are then chosen to match the characteristic impedance of the coax. FIG. 5C is a cut-away side view of the connectors of FIGS. 5A and 5B. In FIG. 5B, the cylindrical inner barrel of the coaxial portion is extended and sliced above and below with linear cuts as illustrated in FIG. 5C. The shape depicted by reference number 506 results from cutting the lower half of the cylinder in a plane as illustrated by reference number 508 in FIG. 5C.

Figure 6:
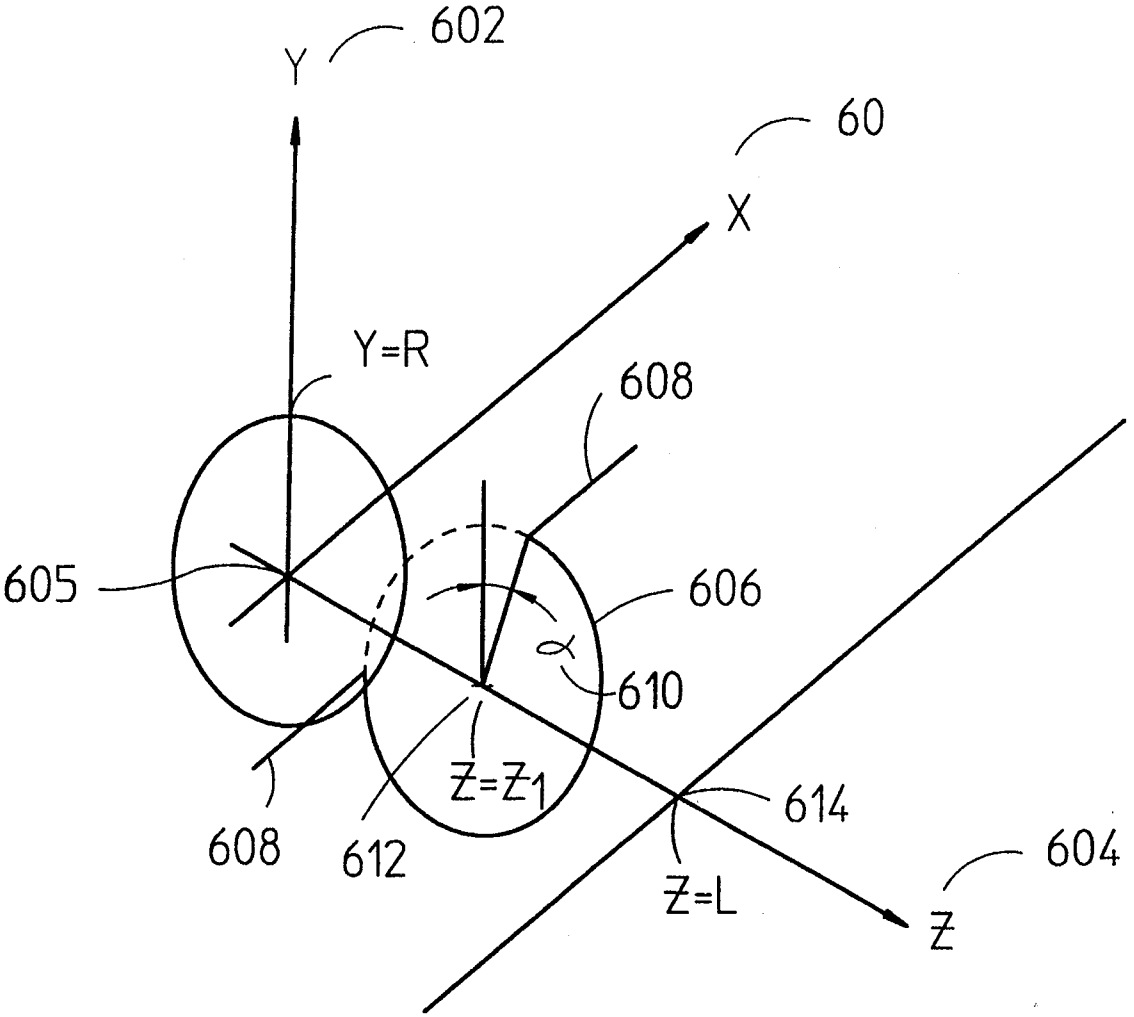
FIG. 6 is a perspective view of a coordinate system to facilitate definitions used in conjunction with embodiments of the present invention.

The linear transitions illustrated in FIGS. 3, 4A, 4B, 5A, 5B and 5C are an improvement over the abrupt transition illustrated in FIGS. 1A–1D. A linear transition, however, is not the optimal transition for minimizing reflections. For the electric fields surrounding a unit length of center conductor, the nearby ground area defines a value of flux/area (see FIGS. 2A–2C). The optimal transition provides a constant rate of change of the area of the ground during the length of the transition. In order to express the optimal transition mathematically, it is useful to define a coordinate system. FIG. 6 illustrates an x,y,z coordinate system. For a connector as in FIG. 3, coordinate x (FIG. 6, 600) is parallel to the ground plane (FIG. 3, 112), coordinate z (FIG. 6, 604) is along the center conductor (FIG. 3, 304) and coordinate y (FIG. 6, 602) is perpendicular to x and z. At z=0 (605), the transmission line ground is the circular interior of the barrel of the coax (FIG. 3, 300). At z=L (614), the transmission line ground is the planar ground of the microstrip (FIG. 3, 112). During the transition, the grounded portion of the transmission line extends upward in the y direction for a distance Y. At z=0 (605), Y is equal to the radius R of the interior of the circular barrel of the coax. By definition, for a linear transition, Y varies linearly with z (that is, Y=Kz for some constant K). For an optimal transition, Y varies non-linearly with z as derived below.

At an intermediate value of z (for example where $z=z_1$, FIG. 6, 612), in the plane defined by z=constant, the transmission line ground has an arc portion (FIG. 6, 606) with straight lines extending from the ends of the arc (FIG. 6, 608) defined by y=constant. That is, a portion of the top of the circular barrel of the coaxial connector is removed. As z is increased, there is a gradual reduction in the length of the arc portion 606 of the transmission line ground, in the plane defined by constant z, until the length of the arc portion 606 is zero when z=L (614) at the edge of the planar ground plane (FIG. 3, 112).

Figure 7:
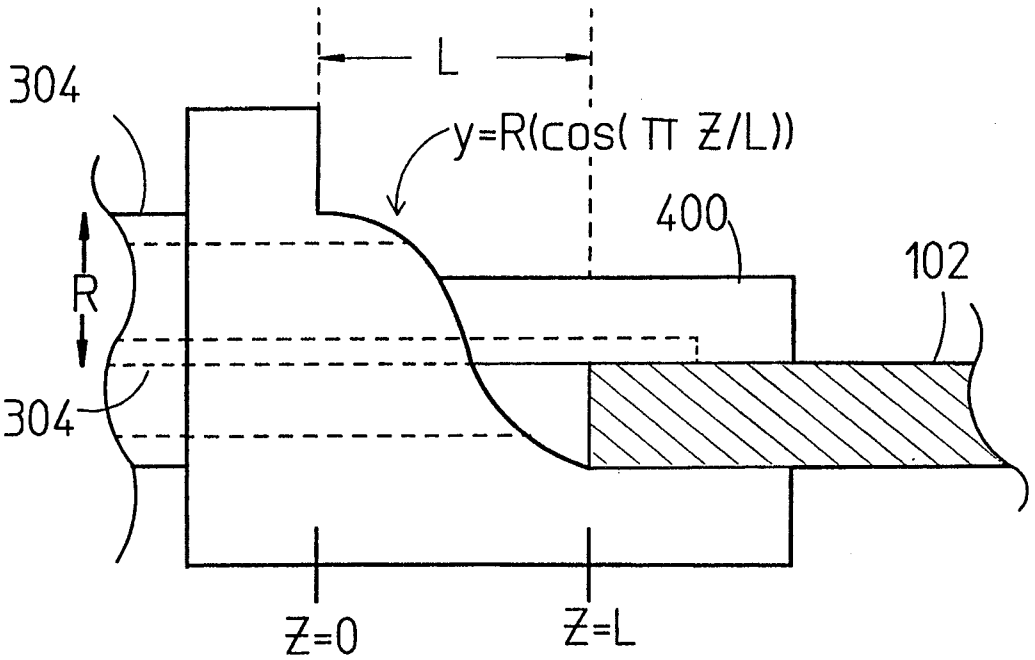
FIG. 7 is a side view of a coaxial to microstrip transmission line connector with a cosine transition.

The initial differential transmission line ground area (z=0, FIG. 6, 605) for a differential length of dz is $(2\pi R)dz$ where R is the inner radius of the coax. At some intermediate point, the differential area is $(2\pi R-2\alpha R)dz$ where the angle $\alpha$ (610) is as illustrated in FIG. 6. For a constant rate of change of area, the angle $\alpha$ (610) must change at a constant rate. Therefore, $\alpha=Kz$ for some constant K. From FIG. 6, $Y=R(\cos(\alpha))=R(\cos(Kz))$. If, for example, the transition length is L, z=L when $\alpha=\pi$. Therefore, $K=\pi/L$ and $Y=R(\cos(\pi z/L))$. FIG. 7 illustrates a side view of a coaxial to microstrip connector with an optimal transition profile as defined above.

Figure 8A:
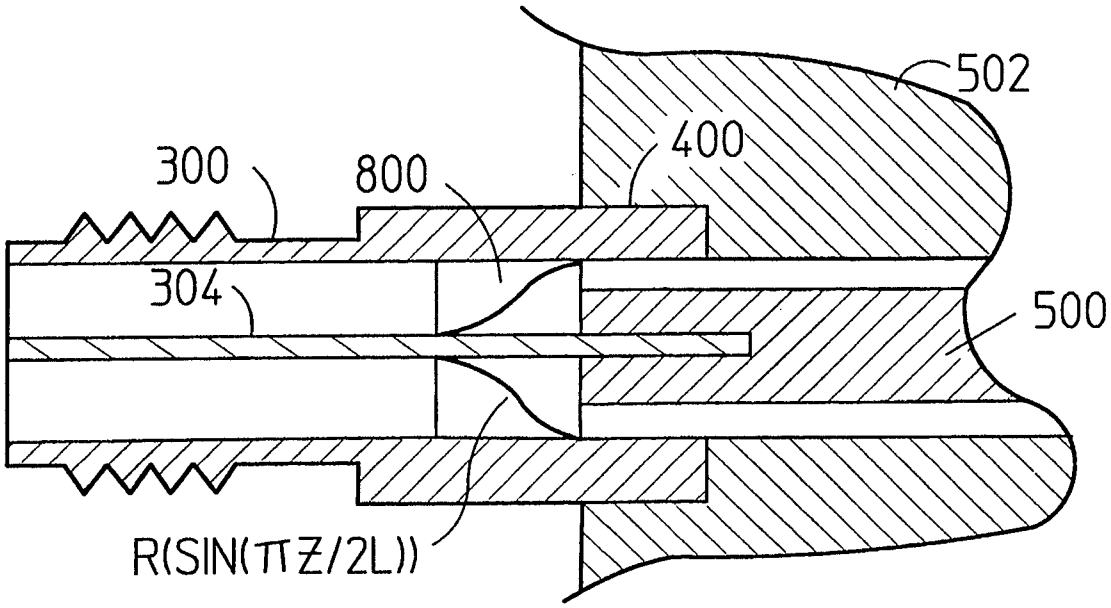
FIG. 8A is a cross-section top view of a coaxial to coplanar transmission line connector with a cosine transition.
Figure 8B:
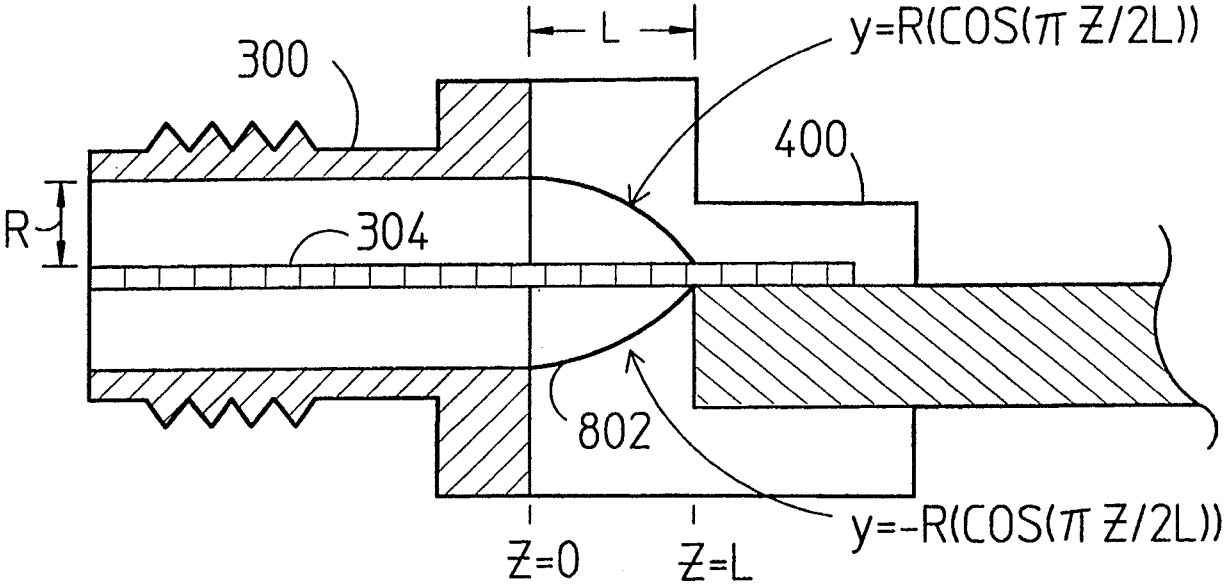
FIG. 8B is a cross-section side view of the connector of FIG. 8A.
Figure 8C:
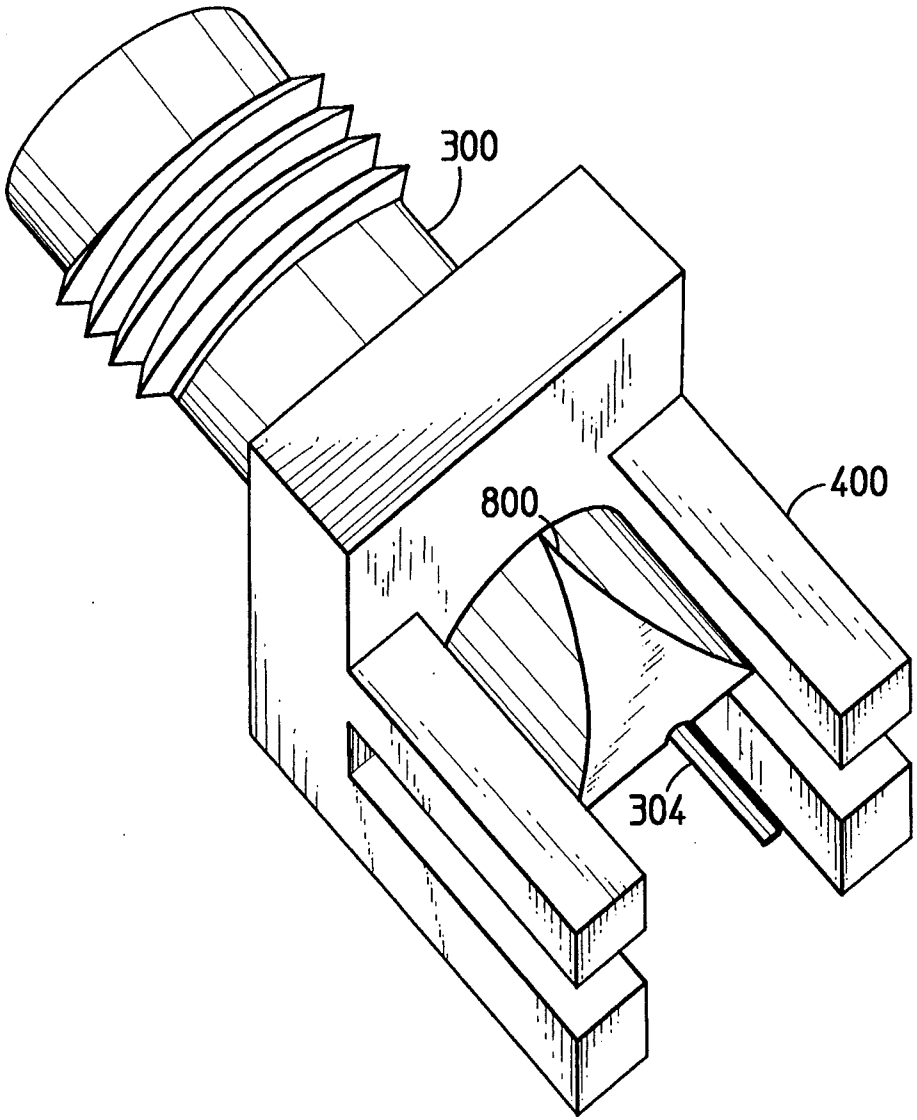

Likewise, for a microstrip to coplanar transition, the arc portion (FIG. 6, 606) is $2\pi R$ at z=0 (FIG. 6, 605) and zero at z=L (FIG. 6, 614). At $z=z_1$ (FIG. 6, 612), the arc portion 606 is $2\pi R-4\alpha R$. Again, $\alpha=Kz$ for some constant K and $Y=R(\cos(\alpha))=R(\cos(Kz))$. For a microstrip to coplanar transition, z=L when $\alpha=\pi/2$. Therefore, $K=\pi/(2L)$and $Y=R(\cos(\pi z/(2L)))$. FIG. 8A illustrates a cut-away top view of a connector with an optimal transition profile as defined above. FIG. 8B illustrates a cut-away side view of the connector illustrated in FIG. 8A. As in FIG. 5B, the inner diameter of the coaxial portion in FIG. 8A is extended and the edge 800 on the lower half of the extended cylinder results from slicing the cylinder as illustrated by line 802 in FIG. 8B.

In summary, the present invention provides improved designs for connectors which adapt a coaxial transmission line to a microstrip transmission line or to a coplanar transmission line. An embodiment with a linear transition provides an improvement over an abrupt transition. An embodiment with a cosine shaped transition provides an optimal transition.

The foregoing description of the present invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An electronic connector comprising:

a first section having a first conductor that is cylindrical and a second conductor that is linear along a central axis of the first conductor and separated from the first conductor by a dielectric, the first and second conductors forming a coaxial transmission line;

a second section having third and fourth conductors that are coplanar, the third conductor uniformly spaced on each side of the fourth conductor, the third and fourth conductors forming a coplanar transmission line;

the first conductor electrically connected to the third conductor, the second conductor electrically connected to the fourth conductor;

a transition section between the first and second sections within which the first conductor has a shape transition change from cylindrical coplanar; and wherein at any point along the second conductor within the transition section, for an infinitesimal length dL along the direction of the second conductor, a differential cross-section area of the first conductor is dA and dA/dL is finite.

2. The connector of claim 1 wherein at any point along the second conductor within the transition section, dA/dL is constant.

3. An electronic connector comprising:

a first section having a first conductor that is cylindrical and a second conductor that is linear along a central axis of the first conductor and separated from the first conductor by a dielectric, the first and second conductors forming a coaxial transmission line;

a second section having third and fourth conductors lying in separate planes, the third conductor adapted to attach to an extended plane of a microstrip transmission line and the fourth conductor adapted to attach to a strip conductor of a microstrip transmission line;

the first conductor electrically connected to the third conductor, the second conductor electrically connected to the fourth conductor;

a transition section between the first and second sections, within which the first conductor has a shape transition change from cylindrical to planar; and wherein at any point along the second conductor within the transition section, for an infinitesimal length dL along the direction of the second conductor, a differential cross-section area of the first conductor is dA and dA/dL is finite.

4. The connector of claim 3 wherein at any point along the second conductor within the transition section, dA/dL is constant.

* * * * *